United States Patent [19]

Freitas

[11] Patent Number: 4,785,709

[45] Date of Patent: Nov. 22, 1988

[54] BRAIDER

[75] Inventor: Glenn A. Freitas, Easton, Mass.

[73] Assignee: Albany Research (UK) Limited, England

[21] Appl. No.: 145,534

[22] Filed: Jan. 19, 1988

[30] Foreign Application Priority Data

Jan. 19, 1987 [GB] United Kingdom ..... 8701108

[51] Int. Cl.[4] ..... D04C 3/06; D04C 3/40; D04C 3/48

[52] U.S. Cl. ..... 87/33; 87/31; 87/34; 87/36

[58] Field of Search ..... 87/14, 15, 31–36, 87/41, 48, 49

[56] References Cited

U.S. PATENT DOCUMENTS 1,854,168 4/1932 Beilhartz ..... 87/34

1,976,931 10/1934 Ford ..... 87/36

*Primary Examiner*—John Petrakes

*Attorney, Agent, or Firm*—Ostrolenk, Faber, Gerb & Soffen

[57] ABSTRACT

This invention relates to a braider having a braid ring about which yarns passing from the yarn packages on the carrier to the article being braided traverse or change direction about the braid ring, vibrators being mounted on the ring to vibrate the ring, thereby allowing yarns of high surface friction to pass over the ring thereby reducing the incidence of yarn breakages during braiding.

5 Claims, 2 Drawing Sheets

BRAIDER

DESCRIPTION

This invention relates to braiders and has particular reference to a braider suitable for use in the braiding of filaments having a degree of surface tack.

The traditional braiding machine comprises a generally circular bed having a planar annular face, a pair of serpentine trackways within said base which intersect one with the other so that each track follows a serpentine path from an outer periphery to an inner periphery and back to an outer periphery. The second track follows a similar, but opposed serpentine path to pass from adjacent the inner periphery when the first track is near an outer periphery and vice versa. Each track is adapted to accommodate a plurality of carriers which travel along said tracks around the bed of the braiding machine: the carriers associated with one track moving in an opposite sense to those of the other. The carriers are typically moved by a series of epicyclic gears which control the movement of each carrier with precision to effect a braiding operation whereby yarns pass under and over each other as the various carriers pass about their respect trackways.

Each carrier carries a yarn package together with attendent guide and take-off eyelet which generally supply the yarn in a direction at a small angle to the perpendicular to the plane containing the trackways. The article to be braided is usually disposed towards the centre area of the braider bed, but in order to pass from the take off eyelet to the article to be braided, it is usually necessary for each individual filament to change direction fairly sharply to converge towards the article being braided.

In operation the carriers and their associated yarn packages move around each of the trackways in the braider bed, the yarns from carriages on the first and the second trackways pass one about the other to effect the braid. As the yarn passes from each yarn package, it contacts the yarn from a yarn package passing in the opposite direction around the bed on the other trackway. Thus, each yarn is brought into intersecting contact with at least one other yarn fairly shortly after it leaves the yarn package. The intersection of one yarn with other yarns continues to build up the braid on the mandrel. Normally braiders produce fabric in a single direction, but when braiding is used to produce a composite preform on an irregularly-shaped mandrel it is often advantageous to traverse the workpiece through the machine past the normal braid formation point so as to lay up on the mandrel a series of layers of braid fabric in which the yarns are continuous throughout and there are no major discontinuities at the turnaround points. This adaption requires the use of a reversing ring to avoid interference between the moving yarn packages and the paid-off yarns, or, for smaller diameter workpieces the use of dual formation rings in order to maintain the position of the fabric formation along the axis of the workpiece.

Thus, the reversing ring is usually a smooth, closed annular ring axially spaced from the bed and from the plane containing the take up eyelets of each yarn package and carrier associated therewith, the ring being substantially fixed so that the yarns slide over the surface in their intersecting relationship so that they will build up in the final braid.

Where the yarns to be braided are smooth and have an effectively low friction surface, no difficulty is experienced in passing the filaments either singly or in intersecting groups over the ring towards the braided article. Where the yarns have a high degree of surface tack, either because of the nature of the yarns themselves or because they contain an impregnant which renders them tacky, then there tends to be an increase in friction between the filament contact during passage over the ring with a consequential result that fouling or breakage of the filaments may occur.

It will be appreciated by the man skilled in the art that the braided structure is in a fully consolidated form at the surface of the mandrel and the degree of consolidation, therefore, increases from the yarn package towards the mandrel surface giving an increase density of crossing points. Thus, the closer any reversing rings or dual formation rings are disposed towards the surface of the mandrel on which the braid is being built up, the greater the problem of friction becomes.

The occurence of these breakages has in the past prevented the braiding of pre-impregnated filaments and yarns or has rendered it time-consumming to such an extent that the process becomes uneconomic.

According to the present invention, there is provided a braider for use in the braiding of yarns having a degree of surface tack in which the yarns pass from a yarn package on a carrier of the braider to the article being braided via a braider ring characterised by vibration means mounted in operative connection with said ring to vibrate the ring during braiding sufficient to allow passage of crossing or intersecting filaments thereover during braiding.

The manner and extent of the vibration applied to the ring will be dependant on the degree of surface tack and the tension to which the yarns re subjected during passage over the ring. In a particular embodiment of the present invention, where the yarns are pre-impregnanted yarns which have a high degree of surface tack, a plurality of vibrators may be disposed at substantially equally circumferentially spaced positions around the ring to apply vibrations of a frequency and amplitude sufficient to reduce the effective coefficient friction between the yarns and the ring and to allow passage of yarns thereover, thereby substantially reducing the incidence of yarn breakages during braiding due to high friction between intersecting filaments and yarns.

In a typical embodiment of the present invention, four vibrators were mounted at circumferentially spaced intervals on the braid ring of a braider.

Following is a description by way of example only and with reference to the accompanying drawings of one embodiment in accordance with the present invention.

Figure 1:
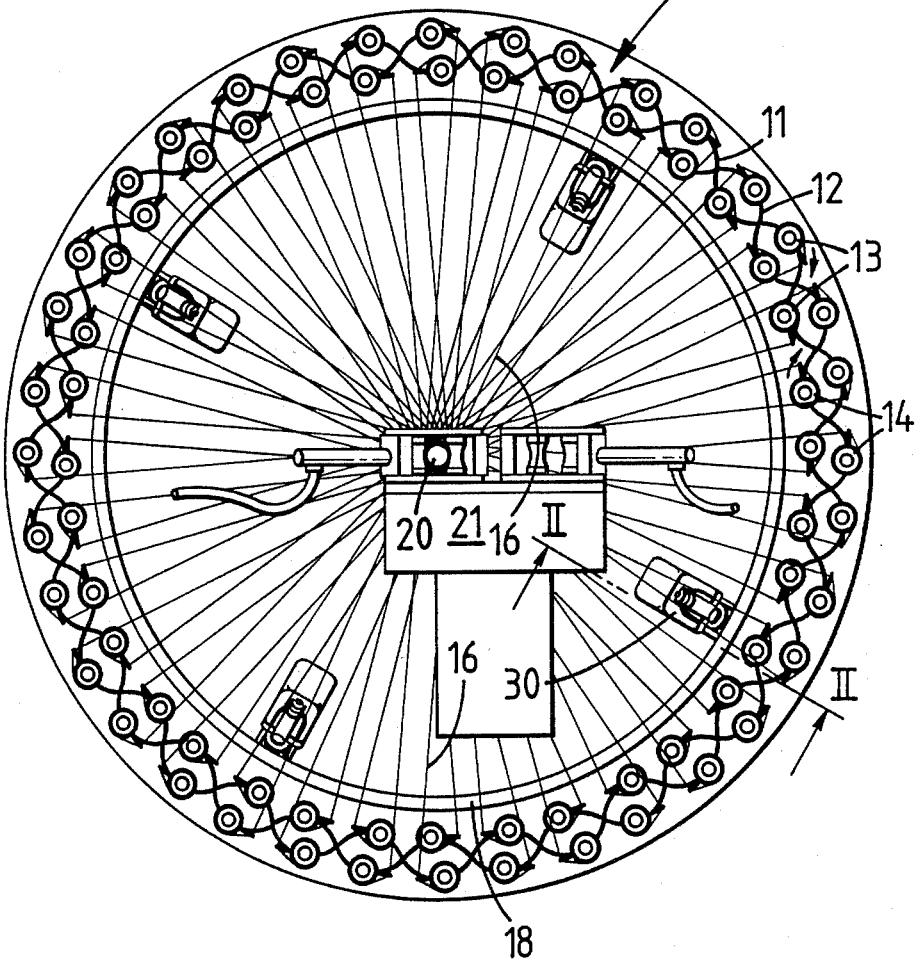
FIG. 1 is an end view of a braider bed.
Figure 2:
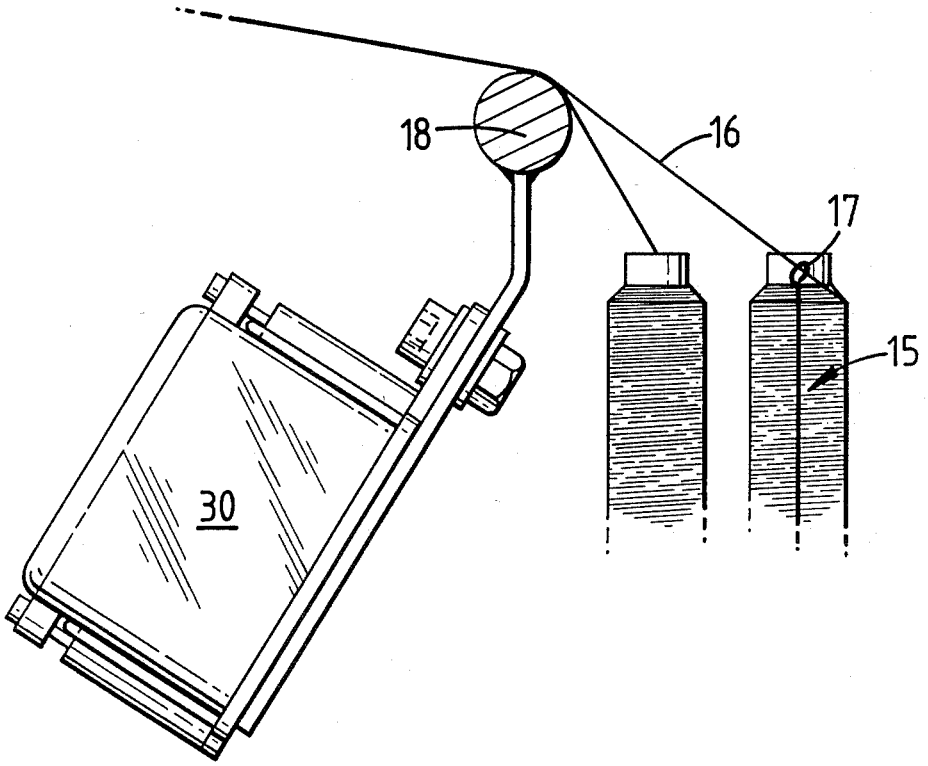
FIG. 2 is a view on the line II—II of FIG. 1.

A braider bed 10 has a pair of intersecting serpentine trackways 11 and 12, each of which carries a first series of yarn package carriers 13 on track 11 and a second series of package carriers 14 on track 12. The package carriers 13 on track 11 traverse the braider bed 10 in a generally clockwise direction and package carriers 14 traverse the braider bed in a generally anti-clockwise direction. Each package carrier carries a yarn package 15 having a spool of yarn 16 which leads from the package via eyelet 17 and passes about a braider ring 18, the yarns leading to a braider mandrel 20 which is withdrawn by mandrel support mechanism 21 for progressive build up of braid on the article.

It will be appreciated by the man skilled in the art that FIG. 1 is a diagram only representing the principle of the invention and that many braiders include fixed yarn packages secured to the braider bed to provide a third substantially stationary array of packages which are inter-braided with moving packages 13 and 14 respectively. These have been omitted for clarity of the drawing.

In order to allow progressive build up of yarn the change of direction about the braid ring permits reversal of the movement of the braider mandrel to permit layers of braid to be built up on the braid support mandrel 20.

In accordance with the invention, a plurality of vibrators 30 are mounted on the braid ring. These are disposed in circumferentially spaced relationship about the ring and each vibrator is a Syntron Model V4 mounted midway between each of the four ring anchoring points (not shown). The frequency of vibration of each vibrator was 60 $H_z$, and the maximum amplitude of vibration of the ring was 50 mils. The electrical supply to each vibrator 30 was provided by means via a central rheostat in order to control the electrical supply to the vibrators, thus permitting control of the amplitude between zero and maximum during the braiding operation.

The braider described above was used to braid a carbon fibre yarn manufactured by the Hercules Company under the reference Hercules 6K AS4 having a yield strength of 1260 yds/lb and impregnated with a curable resin commercially available under the name and reference "Newport Composites N.C. 76 Resin" to give a fibre volume friction of 65%.

The carbon yarn constituted a prepregnated strand yarn with increased level of friction as it passed over the reversing ring. The yarn described above was led to the central mandrel 20 to provide a braid of two biased yarns having a biased angle of substantially 45° of each biased yarn to the longitudinal direction of the mandrel.

An initial run was conducted with the vibrators inoperative and the result was that during braiding there was a considerable amount of sticking or friction at the yarn crossover points passing the reversing ring which resulted in a very uneven braid formation.

The vibrators were then switched on and the rheostat increased to a level at which sticking at the yarn crossovers at the reversing ring was substantially eliminated and this resulted in a much improved braid formation.

The ability to produce even braids with preimpregnated yarn means that ultimate filling or bonding of the yarn components at their crossover points within the braid itself can be readily effected to produce a much improved and stable yarn structure.

I Claim:

1. A braider for use in the braiding of yarns having a degree of surface tack in which the yarns pass from a yarn package on a carrier of the braider to an article being braided, the braider including a braider ring placed for the yarns to pass over moving to the article being braided;

a plurality of vibrators are circumferentially spaced about the ring to apply vibration to the ring during braiding sufficient to allow passage of the crossing or intersecting filaments over the ring during braiding, the vibrations being of a frequency and amplitude sufficient to reduce the effective coefficient of friction between the yarns and the ring to allow passage of yarns thereover.

2. A braider as claimed in claim 1, further comprising an electrical supply to the vibrators and a rheostat controlling the electrical supply for controlling the amplitude of the vibrations of the vibrators.

3. A braider as claimed in claim 1, wherein there are four of the vibrators mounted at circumferentially spaced intervals on the braider ring.

4. A braider as claimed in claim 1, wherein each vibrator has a frequency of 60 $H_z$ and a maximum amplitude vibration of 70 mils.

5. A braider as claimed in claim 4, further comprising an electrical supply to the vibrators and a rheostat controlling the electrical supply for controlling the amplitude of the vibrations of the vibrators.

* * * * *